US007769195B2

(12) United States Patent
Ho

(10) Patent No.: US 7,769,195 B2
(45) Date of Patent: Aug. 3, 2010

(54) MICROPHONE CONNECTOR MODULE

(75) Inventor: Hsin-Tsung Ho, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 1189 days.

(21) Appl. No.: 11/366,363

(22) Filed: Mar. 2, 2006

(65) Prior Publication Data

US 2007/0217631 A1 Sep. 20, 2007

(51) Int. Cl.
*H04R 21/02* (2006.01)

(52) U.S. Cl. ..... 381/361; 381/122; 381/355; 439/620.01; 439/620.06; 439/500; 439/79; 379/433.03; 379/433.05

(58) Field of Classification Search ..... 381/355, 381/122, 361; 439/620, 500, 79, 620.01, 439/620.06; 379/433.03, 433.5
See application file for complete search history.

(56) References Cited

U.S. PATENT DOCUMENTS

| | | | | |
|---|---|---|---|---|
| 4,685,137 | A * | 8/1987 | Watson et al. | 381/174 |
| 5,836,790 | A * | 11/1998 | Barnett | 439/620.22 |
| 6,654,464 | B2 * | 11/2003 | Roussy et al. | 379/433.05 |
| 2003/0039374 | A1 * | 2/2003 | Sudo et al. | 381/355 |

* cited by examiner

*Primary Examiner*—Vivian Chin
*Assistant Examiner*—Friedrich Fahnert

(57) ABSTRACT

A microphone connector module includes a microphone with a receiving face and a contacting face, a body defining a cavity to receive the microphone, a pair of terminals fixed in the body and connecting with the microphone and an external printed circuit board and a casing including a basic portion and a front portion. The basic portion of the casing defines a housing to receive the body. The front portion of the casing defines a voice channel approximately perpendicularly communicating with the housing of the basic portion. The receiving face of the microphone approximately perpendicularly faces to the voice channel and only receives the acoustic waves of single frequency at a time, which avoids the influence of a mixed transformation of the acoustic waves of different frequency to electric signals and enhances the receiving effect of the microphone.

4 Claims, 4 Drawing Sheets

MICROPHONE CONNECTOR MODULE

BACKGROUND OF THE INVENTION

1. Field of the Invention

The present invention relates to a microphone connector module, and particularly relates to a microphone connector module with voice channel.

2. The Related Art

Microphone connector modules are widely used, for example, in mobile telecommunication equipment, such as portable telephones. The connectors are permanently incorporated so that the transformation of the data can be set up with an external information-processing unit, such as a microcomputer. The connectors can transfer electrical power from a source of electrical power to the equipment coupled to the external unit via the appropriate connector. Such a connector also allows an electrical connection to be made between a microphone in the mobile telecommunication equipment and a printed circuit board (PCB) of the mobile telecommunication equipment.

U.S. Pat. No. 6,654,464 issued Nov. 25, 2003 describes a microphone connector module, which includes a microphone, a plurality of terminals, a body and a casing. One end of the terminal connects with the microphone. The other end of the terminal is bent to form an elastic portion to contact with an external PCB. The body defines a cylindrical cavity to receive the microphone. The casing defines a housing for accommodating the microphone connector module and a voice channel communicating with the housing for allowing the external voice to reach the receiving face of the microphone and be received.

However, the receiving face of the microphone faces to the inner wall of the body. While coming into the voice channel, the acoustic wave of the external voice passes the receiving face of the microphone from one side to another. This means that the acoustic waves of different frequency are received by the receiving face of the microphone at the same time. While reaching the receiving face of the microphone, the acoustic wave of each frequency causes the acoustic wave receiving equipment to shake at a single frequency. Then the shaking of the acoustic wave receiving equipment is transformed into an electric signal. While more than one acoustic wave reach the receiving face of the microphone at the same time, the acoustic waves of different frequency may cause the acoustic wave receiving equipment to shake at different frequency, which may influence the shaking of the acoustic wave receiving equipment and further influence the transformation of the voice into electric signals.

SUMMARY OF THE INVENTION

Accordingly, an object of the present invention is to provide a microphone connector module, comprising a microphone having a contacting face and a receiving face, a plurality of terminals, a body and a casing. The bottom portion of the terminal is bent to form a first elastic portion for pressing the contacting face of the microphone. The top portion of the terminal is bent to form a second elastic portion for pressing an external PCB. The body defines a cylindrical cavity to receive the microphone. The casing further includes a basic portion and a front portion stretching forward from the basic portion. The basic portion defines a housing for accommodating the microphone connector module. The front portion defines a voice channel communicating with the housing of the basic portion for allowing the external voice to reach the receiving face of the microphone. The voice channel is approximately perpendicular to the housing of the basic portion. While coming into the voice channel, the acoustic wave of the external voice reaches approximately to the receiving face of the microphone. This structure avoids the influence caused by the receiving of the acoustic waves of different frequency at the same time and enhances the receiving effect of the microphone.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
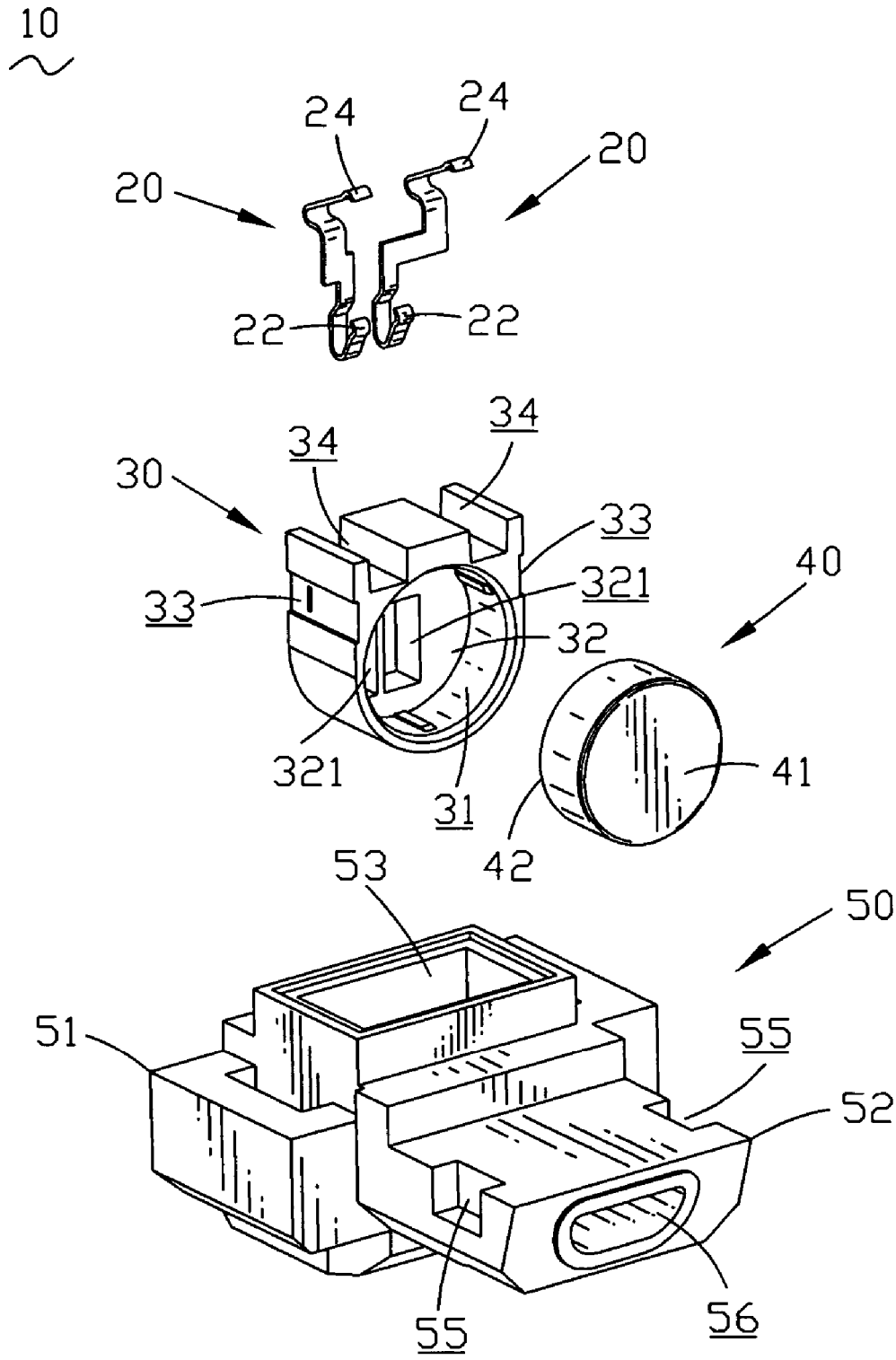
FIG. 1 is an exploded view of a microphone connector module according to the present invention.

Referring to FIG. 1, an embodiment of a microphone connector module 10 in accordance with the present invention is shown. The microphone connector module 10 comprises a pair of terminals 20, a body 30 receiving the terminals 20, a microphone 40 received in the body 30, and a casing 50 receiving the body 30.

As shown in FIG. 1, the microphone 40 defines a receiving face 41 and a contacting face 42 opposite to the receiving face 41.

The terminals 20 are received and fixed in the body 30. The bottom portion of the terminal 20 is bent to form a first elastic portion 22 for pressing the contacting face 42 of the microphone 40. The top portion of the terminal 20 is bent to form a second elastic portion 24 for pressing an external printed circuit board (PCB, not shown).

The body 30 defines a cylindrical cavity 31 for receiving the microphone 40. The back portion of the body 30 defines a back wall 32 as a bottom of the cylindrical cavity 31. The back portion of the body 30 defines a pair of holes 321 for receiving the first elastic portions 22 of the terminals 20. Each of the left and right sides of the body 30 defines a groove 33 for being fixed in the casing 50. The top portion of the body 30 defines a pair of slots 34 for receiving the compressed second elastic portions 24 of the terminals 20.

The casing 50 includes a basic portion 51 and a front portion 52 stretching forward from the basic portion 51. The basic portion 51 defines a housing 53 for accommodating the combination of the body 30. The groove 33 of the body 30 is engaged with a latch (not shown) formed on the inner wall of the housing 53. The front portion 52 forms a pair of locking cavities 55 at left and right sides. The front portion 52 also defines an inner voice channel 56 communicating with the housing 53 of the basic portion 52 for allowing the external voice to reach the receiving face 42 of the microphone 40 and be received. The voice channel 56 is approximately perpendicular to the housing 53 of the basic portion 51.

Referring to FIG. 1 again, while the microphone connector module 10 is assembled, the terminals 20 are received and fixed in the body 30 with the first elastic portions 22 of the terminals 20 located in the holes 321 and pressing the contacting face 42 of the microphone 40. The second elastic portions 24 are located above the slots 34 of the body 30.

Then, the body 30, in which the microphone 40 is installed, is inserted into the housing 53 of the casing 50 with the receiving face 41 of the microphone 40 approximately perpendicularly facing to the inner voice channel 56 of the casing 50.

Figure 2:
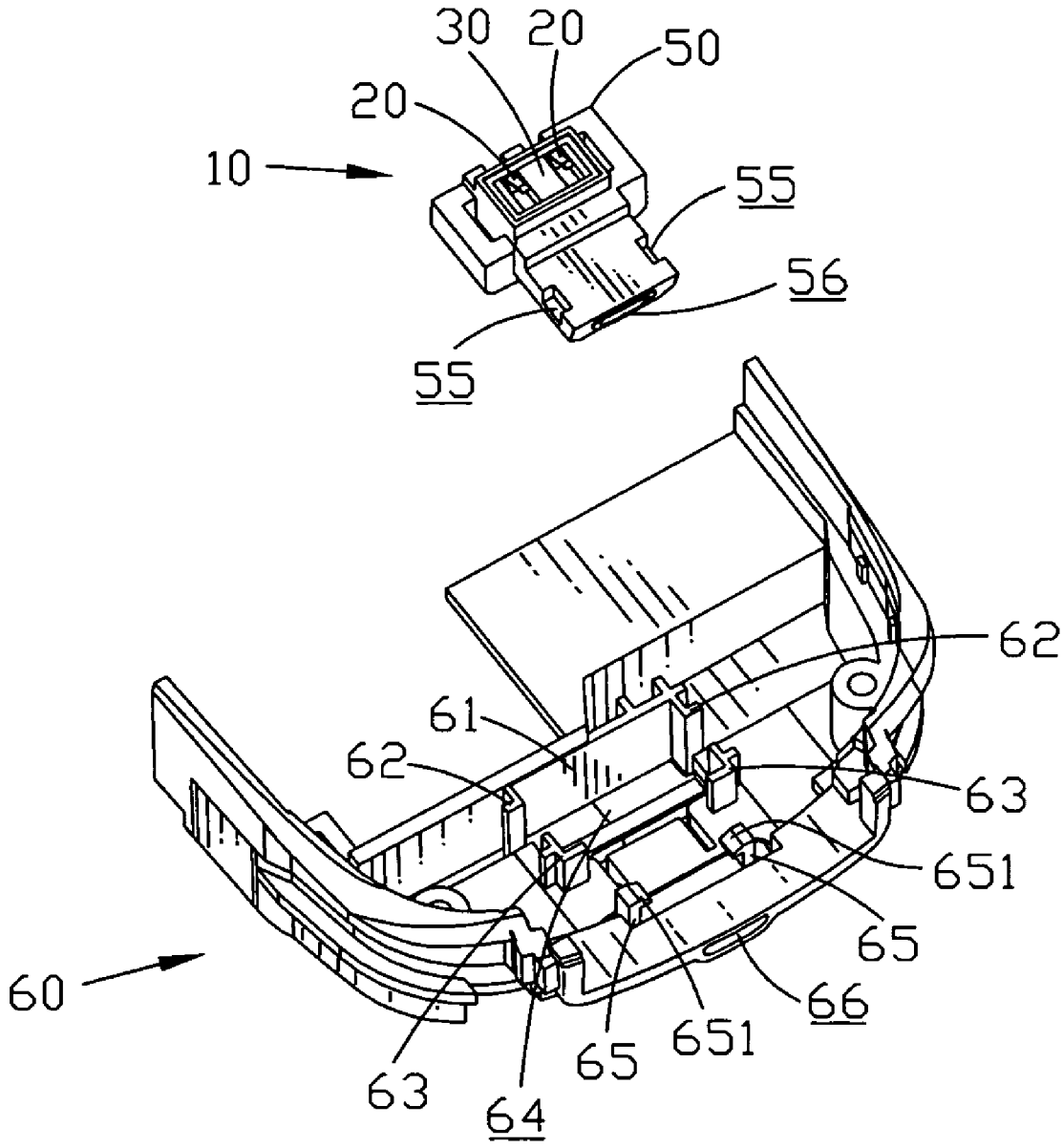
FIG. 2 is a perspective view of the microphone connector module before being assembled to an external cover.
Figure 3:
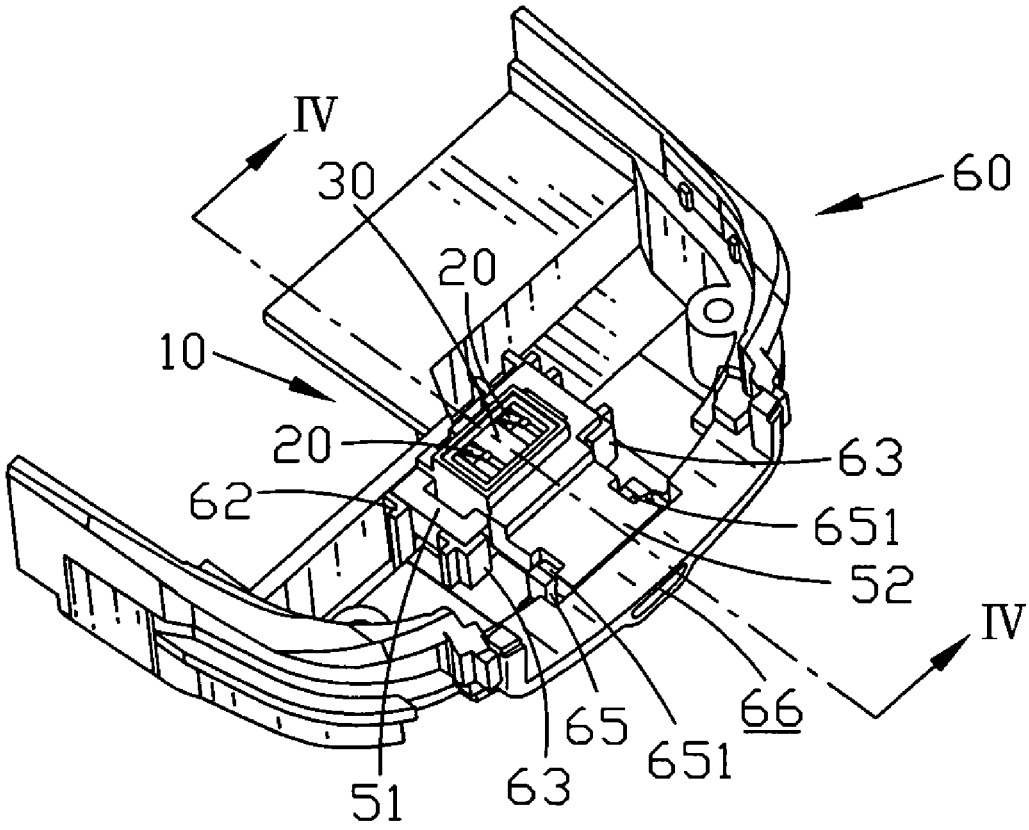
FIG. 3 is a perspective view of the microphone connector module after being assembled to the external cover.

As shown in FIGS. 2-3, an external cover 60 is shown. The external cover 60 includes a first fixing board 61 in the middle portion, a pair of first fixing corners 62 extending forwardly from the sides of the first fixing board 61, a pair of second fixing corners 63 located in front of the first fixing corners 62, a pair of second fixing boards 65 and an external voice channel 66 formed in front edge of the external cover 60. The first fixing board 61, the first and second fixing corners 62, 63 form a fixing space 64 for receiving the basic portion 51 of the casing 50. Each second fixing board 65 defines a locking jut 651 on the top portion for coupling with the locking cavity 55 of the casing 50. While the microphone connector module 10 is fixed in the external cover 60, the locking juts 651 of the second fixing boards 65 lock the front portion 52 of the casing 50.

Figure 4:
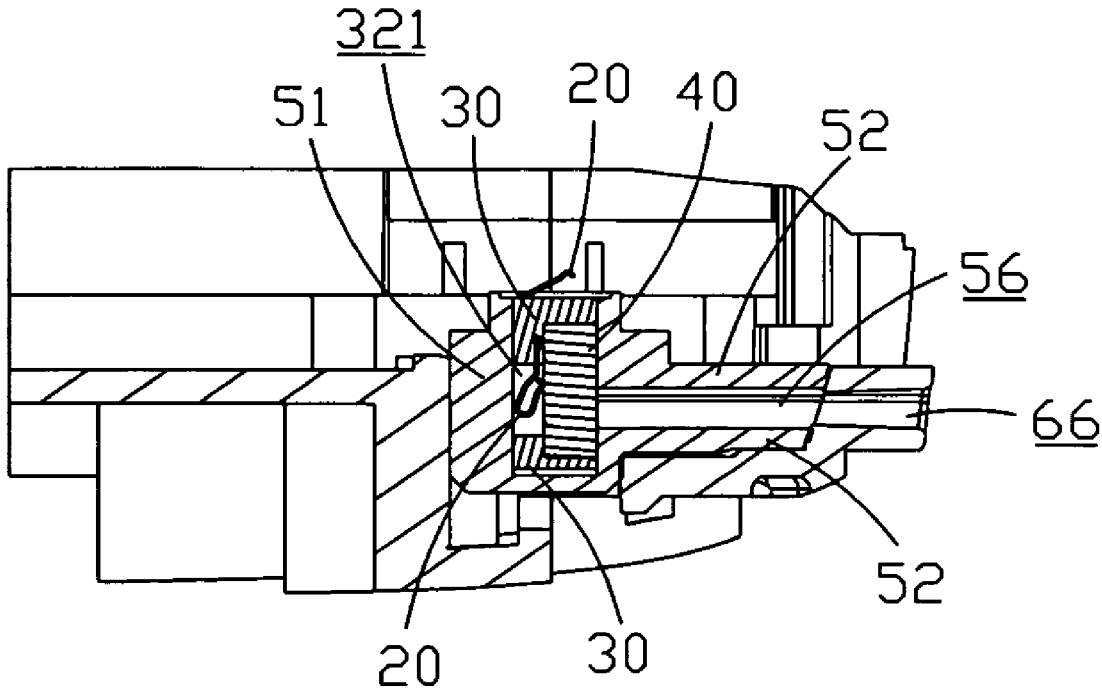
FIG. 4 is a cross-sectional view taken along line IV-IV of FIG. 3.

Now referring to FIG. 4, it is a cross-sectional view of the microphone connector module 10 assembled to the external cover 60. The external voice channel 66 and the inner voice channel 56 communicate with each other in a line which is approximately perpendicular to the receiving face 41 of the microphone 40 for allowing the external voice to come in and perpendicularly reach to the receiving face 41 of the microphone 40. It means that the acoustic wave of the external voice directly and perpendicularly reaches to the receiving face 41 of the microphone 40. Comparing with the traditional microphone connector module, the receiving face 41 of the microphone 40 only receives the acoustic waves of single frequency at a time, which avoids the influence of the mixed transformation of the voice into electric signals caused by the receiving of the acoustic waves of different frequency at the same time and enhances the receiving effect of the microphone 40.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A microphone connector module assembled in an external cover which defines an external voice channel in an edge portion thereof, the microphone connector module comprising:

a microphone defining a receiving face and a contacting face opposite to said receiving face;

a body defining a cavity to receive said microphone;

a plurality of terminals fixed in said body and connecting with said microphone and an external printed circuit board; and a casing including a basic portion and a front portion extending forward from said basic portion, said basic and front portions being a single piece; wherein:

said basic portion of said casing defines a housing to receive said body;

said front portion of said casing defines an inner voice channel perpendicularly communicating with said housing of said basic portion and communicating with said external voice channel of said external cover; and said receiving face of said microphone substantially perpendicularly faces said inner voice channel.

2. The microphone connector module as claimed in claim 1, wherein:

said body defines a back wall and a plurality of holes in said back wall; and a bottom portion of each said terminal is bent to form a first elastic portion located in said hole of said body and pressing said contacting face of said microphone.

3. The microphone connector module as claimed in claim 1, wherein:

said body defines a pair of slots in a top portion of said body; and a top portion of each said terminal is bent to form a second elastic portion located above said slot of said body and pressing said external printed circuit board.

4. The microphone connector module as claimed in claim 1, wherein:

said body defines a plurality of grooves on left and right sides of said body; and said casing defines a plurality of latches on an inner wall of said housing coupling with said grooves of said body.

* * * * *